United States Patent [19]

Stolle

[11] 4,417,668

[45] Nov. 29, 1983

[54] EASY OPEN CAN END WITH PULL TAB HAVING RETAINED TEAR STRIP WITH STRESS RELIEF MEANS

[75] Inventor: Ralph J. Stolle, Lebanon, Ohio

[73] Assignee: Stolle Research and Development Corporation, Cincinnati, Ohio

[21] Appl. No.: 323,749

[22] Filed: Nov. 23, 1981

Related U.S. Application Data

[63] Continuation-in-part of Ser. No. 298,924, Sep. 3, 1981, abandoned.

[51] Int. Cl.[3] ..... B65D 17/34

[52] U.S. Cl. ..... 220/269

[58] Field of Search ..... 220/266–273

[56] References Cited

U.S. PATENT DOCUMENTS 3,847,300 11/1974 Waters ..... 220/269
3,877,606 4/1975 Silver ..... 220/269
3,929,252 12/1975 La Croce ..... 220/269
4,320,850 3/1982 Drohen, Jr. ..... 220/269

*Primary Examiner*—George T. Hall
*Attorney, Agent, or Firm*—Frost & Jacobs

[57] ABSTRACT

An easy open can end having a retained tear strip extending diametrically part way across the can end defined by a score line of non-uniform depth, and a graspable pull tab, which may include fulcrum elements, one on either side of the center line of the pull tab, secured to the tear strip. Lifting of the pull tab initiates tearing of the score line which may be continued to form an opening in the can end. When the pull tab is pressed inwardly to a stored position against the can end, if desired, the tear strip doubles back upon itself to form an arcuate portion in the tear strip lying beneath the surface of the can end which operates to relieve stress and prevent metal fracture of the tear strip which could cause the strip to become separated from the can end.

19 Claims, 16 Drawing Figures

FIG. 5B
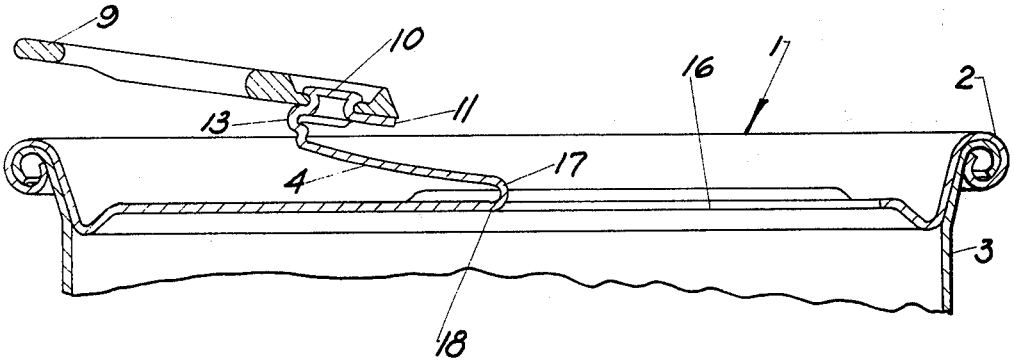
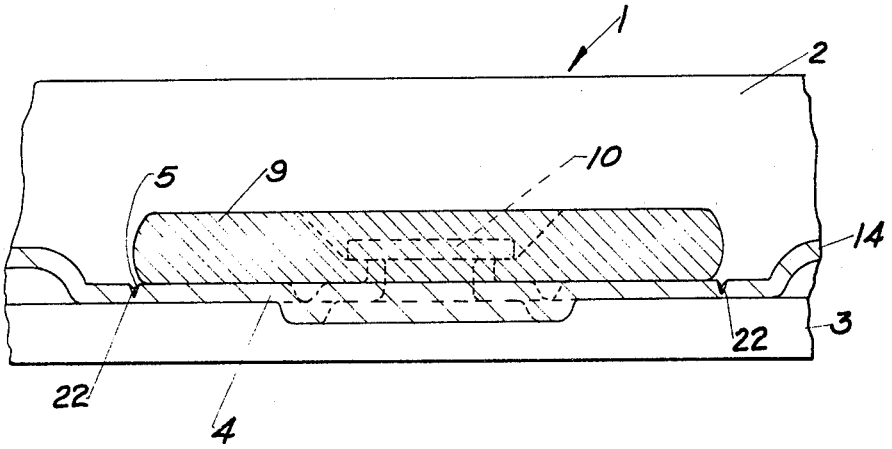
FIG. 7

EASY OPEN CAN END WITH PULL TAB HAVING RETAINED TEAR STRIP WITH STRESS RELIEF MEANS

REFERENCE TO RELATED APPLICATIONS

This application is a continuation-in-part of application Ser. No. 298,924, filed Sept. 3, 1981 in the name of Ralph J. Stolle, entitled "Easy Open Can End Pull Tab Having Retained Tear Strip With Stress Relief Means"; now abandoned.

SUMMARY OF THE INVENTION

The present invention is directed to a pull tab for a metallic beverage type can end or the like, and more particularly to a pull tab which is retained to the can end after opening and includes means for preventing fracture of the tear strip following multiple bending operations.

Many metallic cans for holding beverages or other liquid products are provided with easy open ends having a pull tab attached to a tear strip defined by a score line in the can end which can be pulled to provide an opening in the end for dispensing the can contents.

For ecological and safety reasons, many areas now require that the tear strip and attached pull tab be retained to the can end after opening. In order to meet this requirement, various ways have been suggested for insuring that the tear strip and tab do not become separated from the can end.

For example, in one type of easy open can end, lifting up of the pull tab causes the tear strip to be folded downwardly into the can body to form an opening for dispensing the contents. While such constructions have been widely used, they bear the disadvantage of immersing the unprotected upper surface of the tear strip in the contents of the can, requiring that the can end be cleaned before opening.

Another type of captive tear strip device is illustrated in my U.S. Pat. No. 3,462,042 issued Aug. 19, 1969. While this type of device is easily constructed and operated, under some circumstances the position of the opened tear strip may interfere with drinking from a beverage can, for example.

One suggestion for overcoming this problem is described in U.S. Pat. No. 3,795,342 issued Mar. 5, 1974 to M. A. Ashton. In this construction, the tear strip is doubled back upon itself when the pull tab is pressed inwardly against the top of the can end to fold the tear strip into a slight hollow or depression. It has been found, however, that the sharp bends produced by the accordion folded tear strip may fracture the strip causing it to break away from the can end. This problem may be particularly severe if the strip is flexed a number of times in an attempt to have it lie flat against the can end or to partially reclose the can end opening.

A further prior art attempt to provide a can with easy-open captive tear strip is described in U.S. Pat. No. 3,762,597 issued Oct. 2, 1973 to E. G. Kaminski and F. R. Nadolsky. In this construction the tear strip is torn open by means of a pull tab, which is provided with fulcrum elements which, upon raising the pull tab to initiate the tear, forces a portion of the tear strip upwardly, thereby facilitating the tearing open of the tear strip.

Furthermore it is important in can end manufacture that can ends stack, curl to curl, with no part of one end touching the underside of the end above it in order to avoid abrasion of the lacquers and coatings protecting the basic metal from attack by some canned products. In some types of can end constructions, such as that disclosed in Ashton, for example, the end cannot be vertically stacked to avoid the type of end-to-end contact described.

The present invention is directed to an easy open can end pull tab having a retained tear strip with stress relief means which serves to prevent fracture of the tear strip material and separation from the can end when the tear strip is flexed. In the preferred embodiment illustrated, the retained tear strip extends diametrically part way across the can end and is defined by a score line having a generally arcuate portion lying next to the can end rim, and a pair of spaced portions extending inwardly toward the center of the can end. The score line is profiled or tapered so that it increases in depth from the center portion of the can lid toward the outer rim.

A graspable pull tab is secured by a rivet or the like to the can end within the arcuate portion of the tear line adjacent one end of the tear strip for tearing open the tear strip. The score line at the other end of the tear strip is interrupted so as to bendably retain it to the can end when the tear strip is torn open.

When the tear strip is torn to provide an opening in the can end, the pull tab may be pressed inwardly against the can end to position the pull tab away from the opening. At the same time, if desired, the tear strip may be stored against the outer surface of the can end by doubling it back upon itself accordion fashion to form a relieved region adjacent the interrupted score line and lying beneath the lower surface of the can end which operates to relieve the stress in the tear strip and prevent breaking off of the tear strip when flexed as the tab is pressed flat against the can end. In this position, the opened tear strip exhibits a first bend adjacent the pull tab, a second bend of opposite curvature spaced from the point of attachment of the tear strip to the can end, and a third arcuate bend having a radius of curvature greater than the second bend and located beneath the lower surface of the can end between the point of attachment of the tear strip and the second bend. As will become clear from the detailed description which follows, this third bend of increased radius of curvature spreads the bending stress along a greater length of the tear strip to prevent fracture and separation of the tear strip from the can end.

In still another embodiment the score line is provided with less score residual portions extending from about the transverse bend line behind the rivet (initiated when the pull tab is raised to cause the tear strip to bend downwardly) toward the center of the can end. The less score residual portions enable the pull tab to more easily cam upwardly and relieve the strain on the rivet.

In still a further embodiment, the pull tab is provided with a pair of fulcrum elements, one on each side of the centerline of the tear strip, disposed between the bend line and the nose, serving to pull the tear strip upward behind the rivet and facilitate removal thereof.

Means may also be provided in the form of a pair of beads disposed outwardly of the score line along both sides of the tear strip which serve to support and elevate the pull tab above the surface of the can end to facilitate grasping the tab and to mask the edges of the opening in the can end.

In addition to the other advantages described, the can ends of the present invention may be stacked, curl to curl in overlying relationship with no part of one end touching the underside of the end above it.

Other features of the invention will become apparent from the detailed description which follows:

BRIEF DESCRIPTION OF THE DRAWING

FIG. 5B is a fragmentary cross sectional side elevational view of the can end of FIG. 1 with the tear strip in the partially depressed position.

FIG. 7 is a fragmentary cross sectional view taken along the lines 7—7 of FIG. 1.

DETAILED DESCRIPTION

Figure 1:
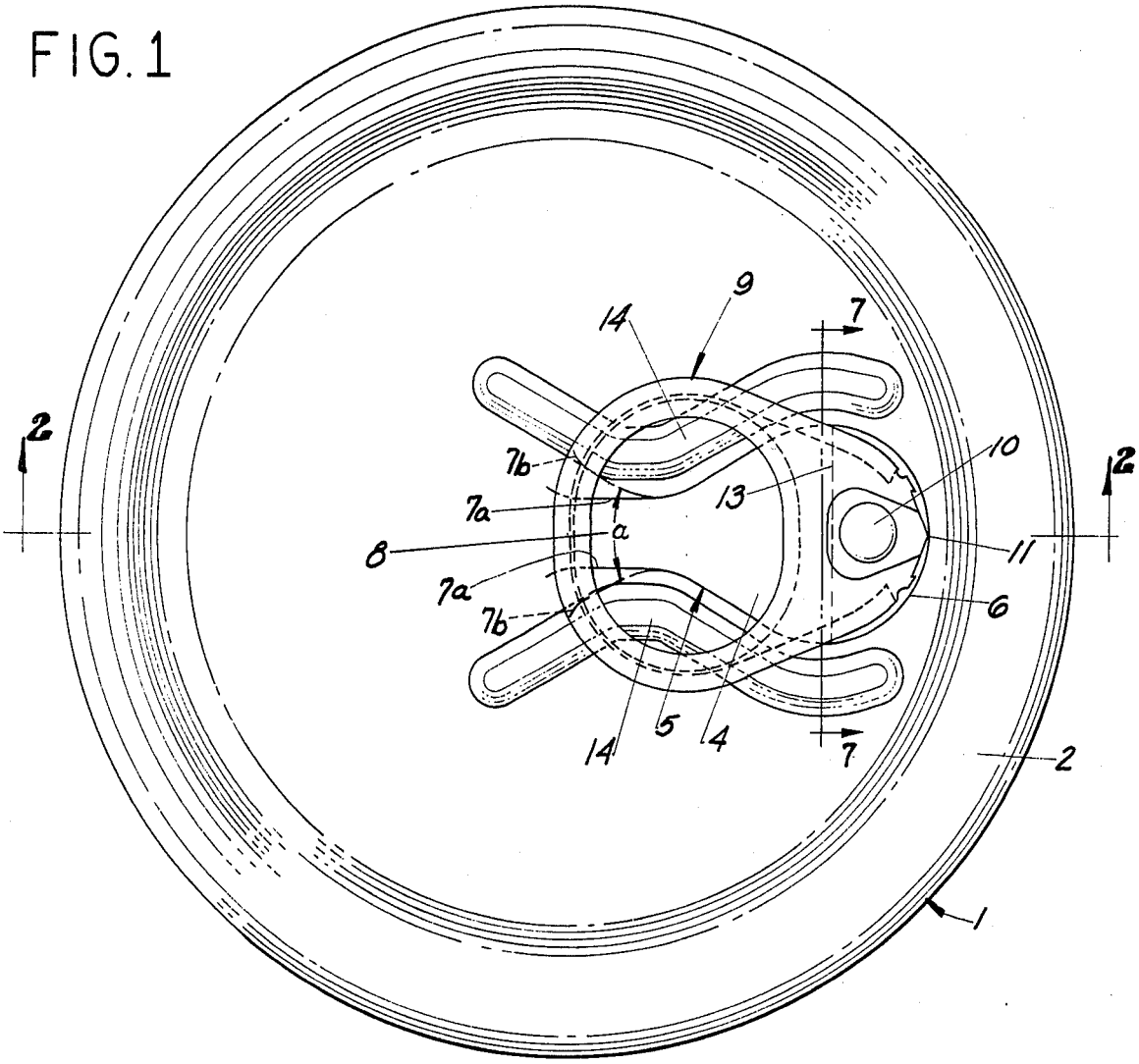
FIG. 1 is a top plan view of the can end of one embodiment of the present invention with the tear strip in the closed position.
Figure 2:
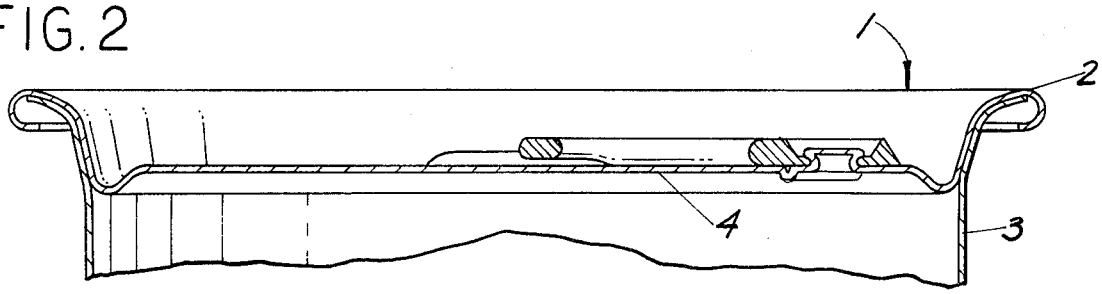
FIGS. 2 is a fragmentary cross sectional view taken along section line 2—2 of FIG. 1.

The can end of the present invention is illustrated generally at 1 in FIG. 1, and is of generally circular shape including a circumferentially extending raised lip 2 for attaching can end 1 to a suitable cylindrical beverage can 3 or the like as is well known in the art. In general, can end 1 will be manufactured of a relatively ductile metal such as aluminum, for example, but may be made from plastic or other materials as required. It will be observed that the configuration of raised lip 2 permits adjacent can ends to be stacked curl to curl in overlying relationships with no part of one end touching the underside of the end above it.

A retained tear strip 4 extends diametrically across the can end from a position spaced just inwardly of raised edge 2 to approximately the center of the can end. Tear strip 4 is defined by a key hole shaped score or tear line 5 having a generally circular or arcuately shaped portion 6 lying adjacent the can end edge 2. Score line 5 terminates at the center of the can end in a pair of spaced score line portions 7 which form the other end of retained tear strip 4. The spaced score line portions 7 may be at least generally parallel, as shown at *7a*, or may be skew to each other so as to form an acute angle "a" as they progress to the center of the can end 1, as shown at *7b*. The angle "a", which is determined by practical considerations, may be provided so as to provide clearance to the portion of the tear strip 4 as it is pushed downwardly on through the can end 1 as generally indicated at 20 and 21 in FIG. 6. For best operation of the retained tear strip of the present invention, it has been found that the portion of the tear strip 4 lying between the score line portions 7 should be about 22% of the total length of the tear strip.

Figure 3:
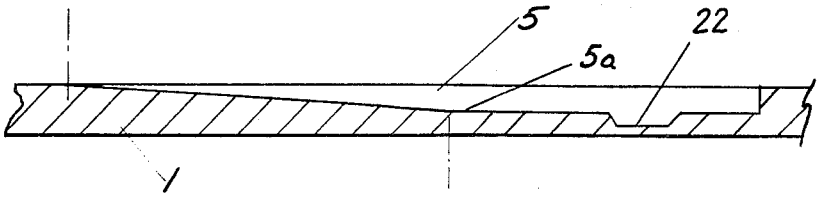
FIG. 3 is an enlarged fragmentary cross sectional view showing the score line profile detail of the can end of FIG. 1.

As best shown in FIG. 3, the score line is tapered or profiled such that it increases in depth as it progresses outwardly from the center of the can end 1 toward raised edge 2. In a preferred embodiment, the score line will have practically no depth beginning at the innermost end of score line portions 7, but extending toward raised edge 2 in a more or less linear fashion to a depth of approximately one half the can end thickness at a point 5*a* as shown in FIG. 3. In other words the score line 5 becomes shallower as it approaches the ends of the score line portions 7, and disappears entirely at the ends of the score line portions 7. As will be explained in more detail hereinafter this profile of the score line in combination with the neck-like part 8 of the tear strip cooperate to initiate bends in the tear strip for flattening the tear strip against the upper surface of can end 1 and for relieving stress in the bent portions of the tear strip.

Can end 1 of the present invention also includes a graspable ring-like pull tab 9 of any desired size and configuration. Pull tab 9 is secured by a rivet 10 or the like to the can end within the arcuately shaped part 6 of score line 5 adjacent one end of tear strip 4, and is used to tear open the tear strip as is well known in the art.

Figure 4B:
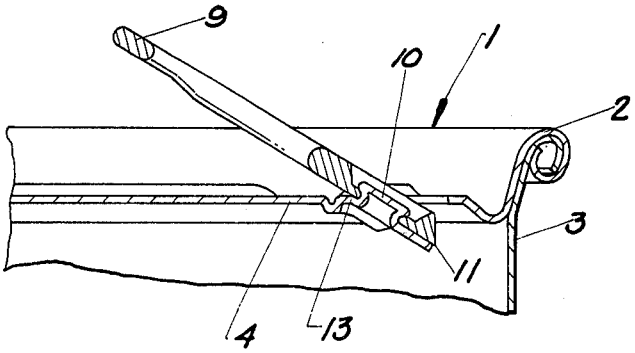
FIG. 4B is a fragmentary cross sectional view taken along section line 4B—4B of FIG. 4A.
Figure 4A:
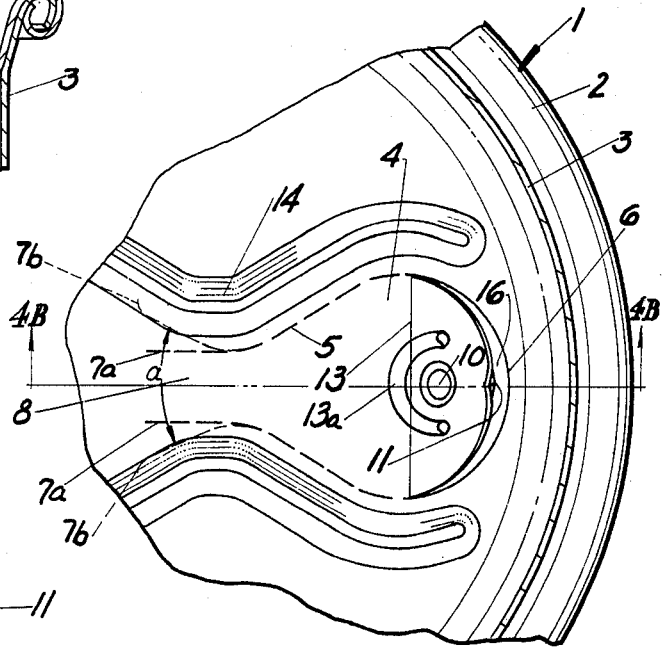
FIG. 4A is a bottom plan view of the can end of FIG. 1 with the pull tab lifted to initiate a tear in the score line.

The outermost end of pull tab 9 forms a nose portion 11 adjacent rivet 10 which operates to initiate a tear along score line 5 upon lifting up of the pull tab. In doing so, the tear strip bends along the line indicated at 13. The exact position of this bend may vary from a point substantially tangent to the rear of the rivet 10 to a point perhaps 1/16th inch or more behind the rivet 10, i.e., away from the nose 11. At this point, the pull tab and tear strip will appear as shown in FIG. 4A and FIG. 4B. Bending along bend line 13 is facilitated by semicircular bead 13*a* partially surrounding the underside of rivet 10 as shown in FIG. 4A.

The present invention also contemplates a score line profile having less score residual 22, as best seen in FIGS. 3 and 7, extending approximately from the base of the rivet 10 or the bend line 13 toward the center of the can end 1 a sufficient distance to assure that the weakened area 22 has less score residual but not a distance so great as to detrimentally affect the pressure retention capability of the can end 1. This assures that the pull tab 9 will cam up easier, take the strain off the rivet 10, and/or reduce the effort required to initially pull the tear strip 4 toward the center of the can end 1.

A sinuously shaped raised bead 14 is disposed outwardly of score line 5 along both sides of tear strip 4. The innermost end of pull tab 9 rests on the upper surfaces of beads 14 so as to elevate the pull tab above the surface of the can end to facilitate grasping of the tab. In addition, after tear strip 4 has been removed to form an opening in can end 1, raised beads 14 also serve to mask the possible sharp edges of the opening. If the score line portions 7 are skew to each other, as shown at *7b*, the raised bead 14 is modified in shape so as to be almost contiguous with the score line portions *7b*.

After a tear in score line 5 has been initiated as shown in FIG. 4A and FIG. 4B, the pull tab may be pulled rearwardly to completely sever the remaining portions of the score line and expose opening 16 in can end 1. It will be observed that score line 5 is interrupted at the other end of tear strip 4 so as to bendably retain the tear strip to the can end when the strip is torn open. Furthermore, as a result of the tapered or profiled score line construction as described hereinabove, increasing force is necessary to sever the tear strip from the can end as the pull tab is pulled away from the opening 16. This, in combination with the neck-like part 8 of the tear strip produces a curved portion 17 lying between the point of attachment 18 of tear strip 4 to can end 1 and a sharper bend along bend line 13 caused by the tear initiating action described previously in connection with FIG. 4A and FIG. 4B. This sharper bend, best seen at 19 in FIG. 6, is necessary to permit the pull tab 9 and tear strip 4 to lay as closely as possible to the upper surface of can end 1.

Figure 6:
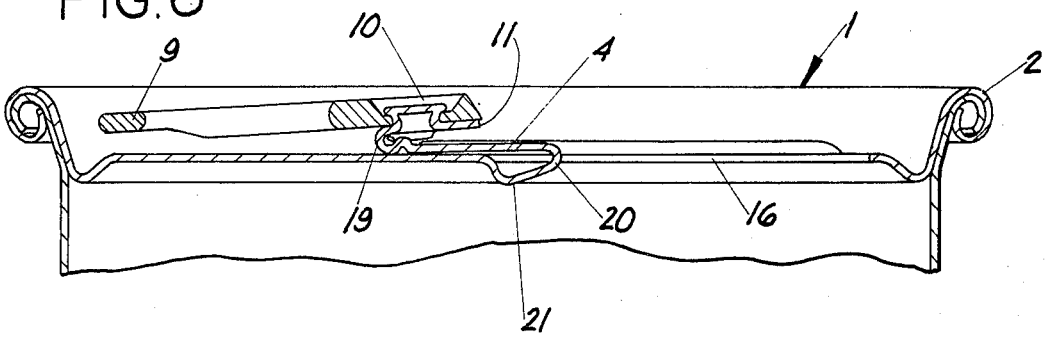
FIG. 6 is a fragmentary cross sectional side elevational view of the can end of FIG. 1 with the pull tab stored against the upper surface of the can end.
Figure 8:
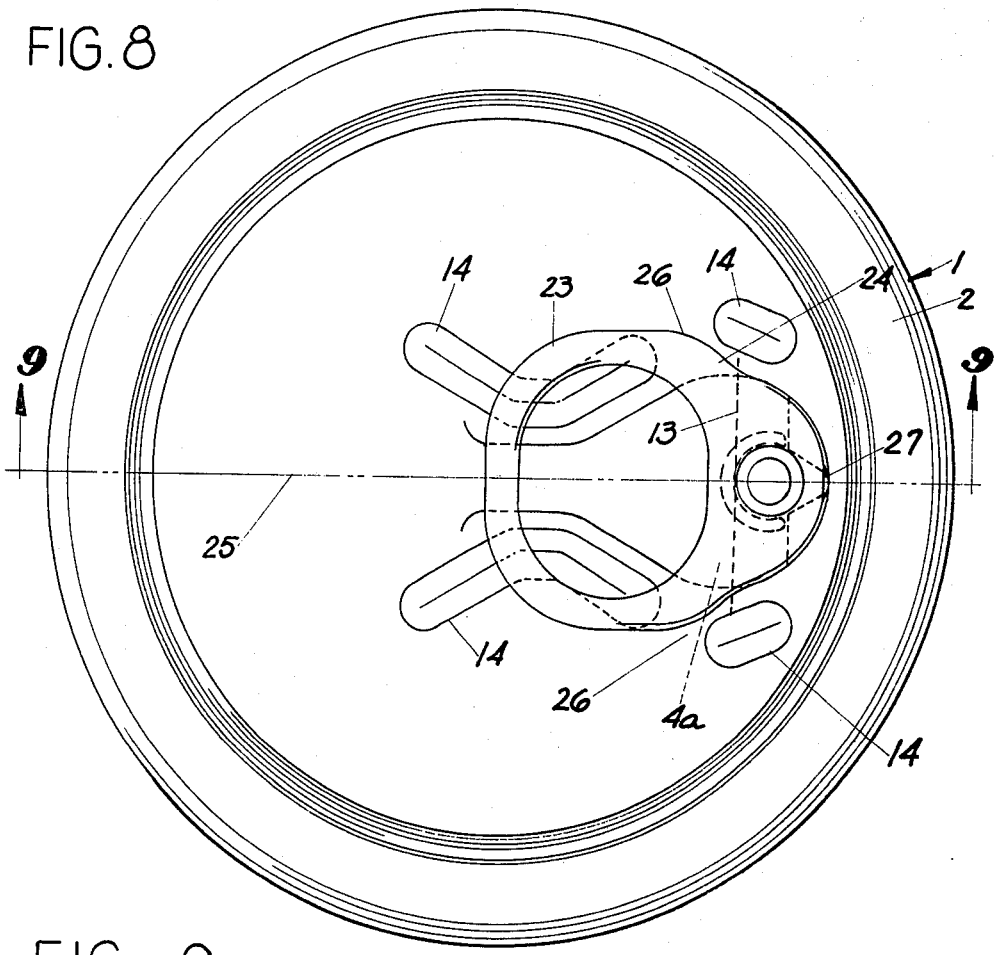
FIG. 8 is a top plan view of a second embodiment of a can end of the present invention with the tear strip in the closed position.
Figure 9:
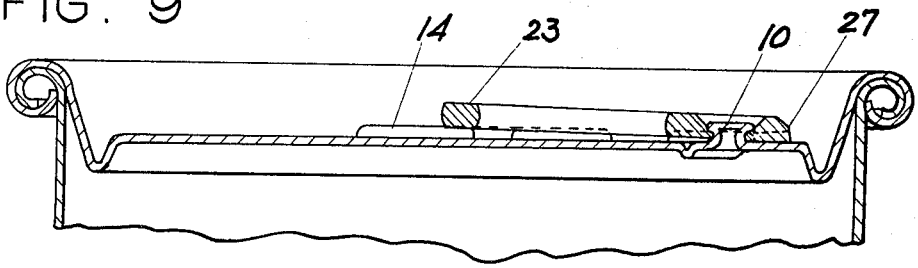
FIG. 9 is a fragmentary cross sectional view taken along the section line 9—9 of FIG. 8.
Figure 10:
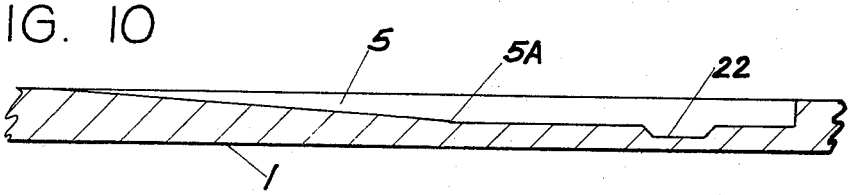
FIG. 10 is an enlarged fragmentary cross sectional view showing the score line profile detail of the can end of FIG. 8.
Figure 11:
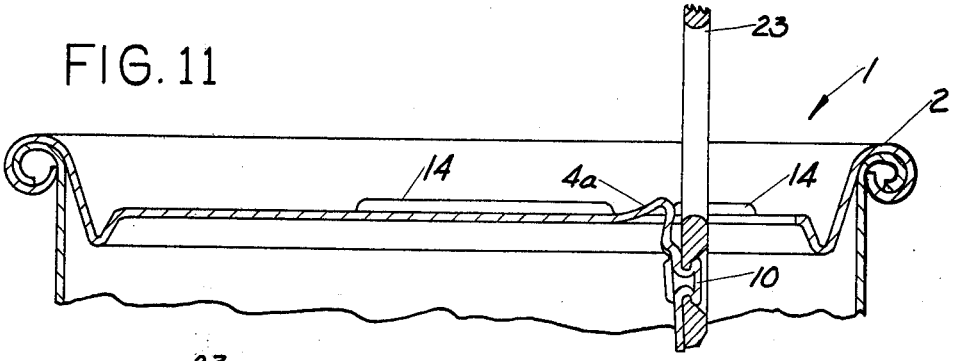
FIG. 11 is a fragmentary cross sectional side elevational view of the can end of FIG. 8 with the pull tab lifted to initiate a tear in the score line.
Figure 12:
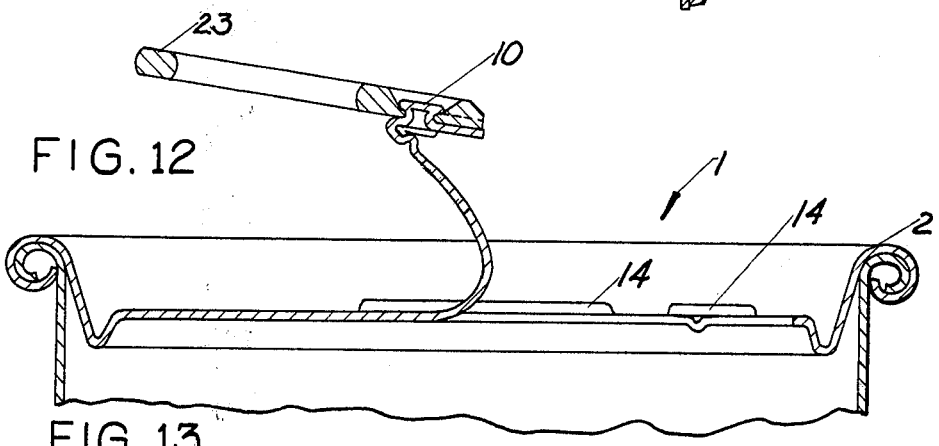
FIG. 12 is a fragmentary cross sectional side elevational view of the can end of FIG. 8 with the tear strip in the fully opened position.
Figure 13:
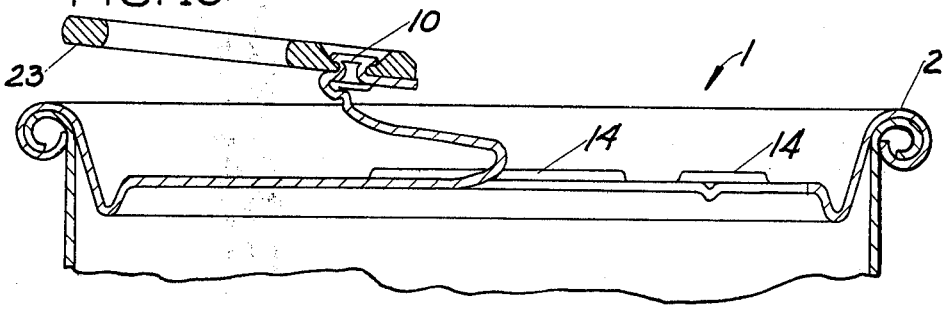
FIG. 13 is a fragmentary cross sectional side elevational view of the can end of FIG. 8 with the tear strip in the partially depressed position.
Figure 14:
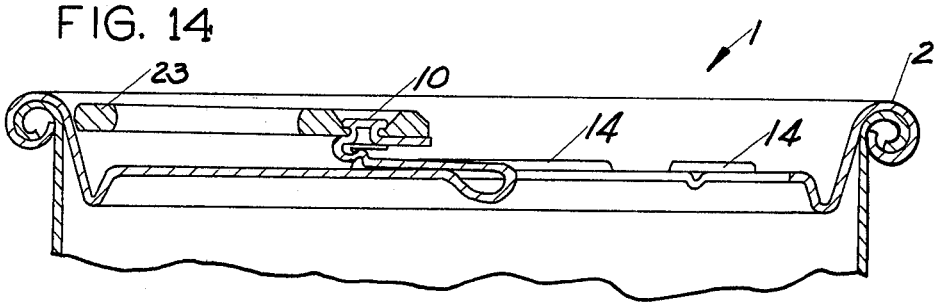
FIG. 14 is a fragmentary cross sectional side elevational view of the can end of FIG. 8 with the pull tab stored against the upper surface of the can end.

In FIG. 6, the can end of the present invention is shown in the stored position where the pull tab 9 has been recessed inwardly against the upper surface of can end 1 causing tear strip 4 to double back upon itself thereby enabling the pull tab to be pressed flat against the can end. In this position, retained tear strip 4 contains a first fold or bend 19 adjacent pull tab 9 and lying substantially along bend line 13, and a second bend or fold 20 of opposite curvature spaced between the point of attachment 18 of the tear strip to the can end and first bend 19. A third bend 21 is also formed resulting from previously described bend 17 and is located between the point of attachment of the tear strip to the can end and second bend 20. Third bend 21 has a radius of curvature greater than that of second bend, and is positioned partially beneath the lower surface of can end 1 so as to form a relieved region in the tear strip to relieve concentrated stress and prevent breaking of the tear strip when flexed. It will be observed that the arcuate portion of the tear strip forming larger radiused bend 21 lies within a part of opening 16 formed when the neck-like part 8 of the tear strip is removed thereform. However, the portion of the opening recovered does not significantly interfere with dispensing of the contents of the can nor does the portion of tear strip 4, shown at bends 20 and 21 protrude sufficiently toward the interior of the can to contact the can contents.

Figure 5A:
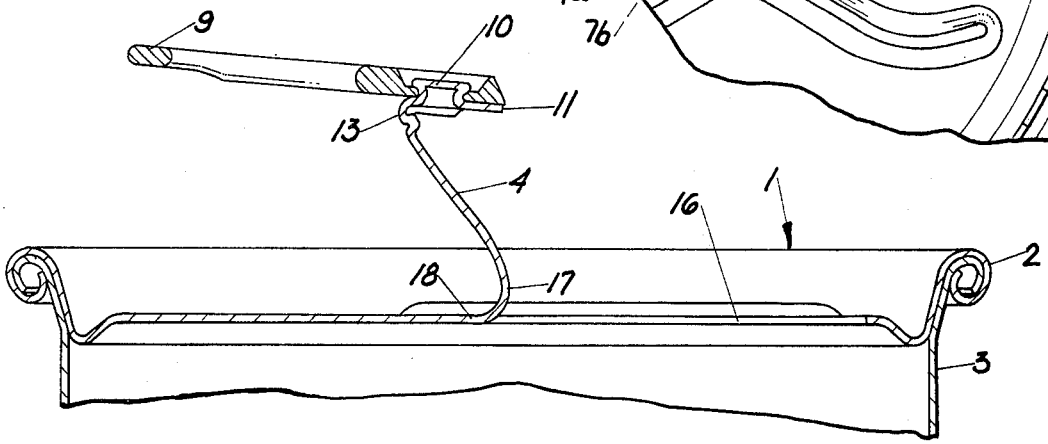
FIG. 5A is a fragmentary cross sectional side elevational view of the can end of FIG. 1 with the tear strip in the fully open position.

It will, of course, be understood that the can end 1 is a good functional end whether the pull tab 9 is pushed or depressed against the top of the can end 9, such as shown in FIGS. 5A, 5B and 6. It will, of course, be noted that in either the case of FIG. 5B or FIG. 6 a radius or bend is obtained which allows flex or moving back and forth of the pull tab 9 without breaking the pull tab 9 off the can end 1.

FIGS. 8–14 disclose the can end 1 of the present invention incorporating a pull tab 23 which is provided with a pair of fulcrum elements 24, one on either side of the center line 25 of the tear strip 4. The nose portion 27 adjacent rivet 10 is shown in modified version. In all other respects, this embodiment is identical to that of FIGS. 1 through 6 and like parts have been given like index numerals.

The pull tab 23 of the embodiment of the invention shown in FIGS. 8 through 14 contemplates the provision of fulcrum elements 24, in the form of abutments or offsets, on each side of the center line 25 of the pull tab 23 and disposed in front of the bend line 13. The exact position of the fulcrum elements 24 is not critical except that preferably they should be in front of the bend line 13 and preferably fairly close to the bend line 13, since they will provide greater leverage if they are closer to the bend line 13 than to the nose 27. It will be clear, if seen in FIGS. 8 and 11, that as the pull tab 23 is raised to the vertical position, the tear strip 4 is torn upwardly in the region *4a*. From this point on, it is a simple matter to tear open the tear strip 4 all the way by pulling backward on the ring of the pull tab 23.

Except as indicated hereinabove, the embodiment of FIGS. 8 through 14 operates in precisely the same manner as described in connection with the embodiment of FIGS. 1 through 7.

It will be understood that the changes in the details, materials, steps and arrangements of parts, which have been herein described and illustrated in order to explain the nature of the invention, may be made by those skilled in the art within the principle and scope of the invention as expressed in the appended claims.

What is claimed is:

1. In a can end having a retained tear strip extending radially from approximately the center of the can end to near the can end rim, said tear strip being defined by a score line of keyhole shape having a rounded portion adjacent the can end rim, and a relatively narrow portion defined by two portions of the score line terminating in spaced relation to each other so as to make said tear strip captive when torn open, said score line becoming shallower as it approaches the end of said portions, and disappearing entirely at the said ends, a pull tab secured to said tear strip by means of a rivet or the like adjacent the rounded end thereof within said score line, and having a nose to initiate a tear along said score line upon lifting of said pull tab, said pull tab, when raised, causing said tear strip to bend downwardly along a transverse line behind said rivet, initiating a tear in said score line and forming a first bend in said tear strip, said pull tab, when retracted, completing the opening of the end and forming a reverse bend in said tear strip adjacent said end, and said pull tab, if desired, when depressed against the top of said can end, causing said first bend to be flattened, and causing said second bend to form a third bend extending below the surface of the can end and having a radius of curvature greater than that of said second bend, said third bend providing a relief for said second bend to prevent breaking of said tear strip when flexed.

2. The can end according to claim 1 wherein said relatively narrow portion is defined by two generally parallel portions of the score line.

3. The can end according to claim 1 wherein said relatively narrow portion is defined by two portions of the score line skew to each other and forming an acute angle as they progress to the center of said can end.

4. The can end according to claim 1 wherein said retracted and depressed pull tab is held in close overlying relationship with said can end.

5. The can end according to claim 1 wherein said third bend is formed in said relatively narrow portion of said tear strip.

6. The can end according to claim 1 wherein said relatively narrow portion of said tear strip defined by said two portions comprises about 22% of the total length of said tear strip.

7. The can end according to claim 1, including means associated with said can end for elevating the pull tab above the surface thereof to facilitate grasping the tab and for masking the opening so formed in the end.

8. The can end according to claim 1 wherein said elevated means comprises a raised bead disposed outwardly of the score line along both sides of the tear strip and serving to support the pull tab.

9. The can end according to claim 1 wherein said tear strip extends about half way across the can end.

10. The can end according to claim 1 wherein said first and second bends are of opposite curvature so that the pull tab may be pressed flat against the can end.

11. The can end according to claim 1 wherein said score line is provided with less score residual portions extending from said bend line toward the center of said can end, whereby said pull tab will more easily cam upwardly, relieve the strain on said rivet, and/or reduce the effort required to initially pull said tear strip toward the center of said can end.

12. The can end according to claim 11 wherein said score line residual portions extend toward the center of said can end a sufficient distant to assure a weakened area along said score line but not a distance so great as to detrimentally affect the pressure retention capability of the can end.

13. The can end according to claim 1 wherein said pull tab is provided with a pair of fulcrum elements, one on each side of the center line of said tear strip, said fulcrum elements being disposed between said bend line and said nose, and serving to pull said tear strip upward behind said rivet and facilitate removal thereof.

14. The can end according to claim 13 wherein said fulcrum elements are disposed nearer said bend line than said nose.

15. The can end according to claim 13 wherein said fulcrum elements are constituted by off-sets in said pull tab extending outwardly beyond said score line.

16. The can end according to claim 13 including means associated with said can end for elevating the pull tab above the surface thereof to facilitate grasping the tab and for masking the opening so formed in the end, said elevated means being interrupted to accommodate said fulcrum elements.

17. The can end according to claim 16 wherein said elevated means comprises a raised bead disposed outwardly of the score line along both sides of the tear strip and serving to support the pull tab.

18. The can end according to any one of claims 13 through 17 wherein said score line is provided with less score residual portions extending from about said bend line toward the center of said can end, whereby said pull tab will more easily cam upwardly, relieve the strain on said rivet, and/or reduce the effort required to initially pull said tear strip toward the center of said can end.

19. The can end according to any one of claims 13 through 17 wherein said score line is provided with less score line residual portion extending from about said bend line toward the center of said can end a sufficient distance to assure a weakened area along said score line, but not a distance so great as to detrimentally affect the pressure retention capability of said can end, whereby said pull tab will more easily cam upwardly, relieve the strain on said rivet, and/or reduce the effort required to initially pull said tear strip toward the center of said can end.

* * * * *